US006968853B2

(12) United States Patent
Amazorrain

(10) Patent No.: US 6,968,853 B2
(45) Date of Patent: Nov. 29, 2005

(54) POWER OPERATED GAS VALVE FOR HEATING, WITH A SAFETY VALVE

(75) Inventor: Maite Amazorrain, Mondragon (ES)

(73) Assignee: S. Coop. Fagor, Mondragon (ES)

( * ) Notice: Subject to any disclaimer, the term of this patent is extended or adjusted under 35 U.S.C. 154(b) by 103 days.

(21) Appl. No.: 10/615,637

(22) Filed: Jul. 8, 2003

(65) Prior Publication Data

US 2005/0005965 A1 Jan. 13, 2005

(51) Int. Cl.[7] ..... F16K 11/10
(52) U.S. Cl. ..... 137/66; 137/870; 251/66; 251/129.11
(58) Field of Search ..... 251/129.11, 68; 137/66, 65, 866, 870

(56) References Cited

U.S. PATENT DOCUMENTS 2,901,034 A * 8/1959 Puttfarcken et al. ..... 137/66
3,850,189 A * 11/1974 Follett ..... 251/65
4,437,388 A * 3/1984 Budzich ..... 251/129.11
4,526,342 A * 7/1985 Wakefield ..... 251/129.11
5,785,511 A * 7/1998 Shah ..... 137/65
5,979,484 A * 11/1999 Grando et al. ..... 251/129.11

* cited by examiner

*Primary Examiner*—John Bastianelli
(74) *Attorney, Agent, or Firm*—The Kline Law Firm

(57) ABSTRACT

The motor-operated valve for regulating a gas flow is the lift type with a modulating valve cut-off member (11), coupled to a valve spindle (10,10*a*) sliding linearly along a central gas flow conduit (5). A flame safety valve is open initially due to the pressure of the spindle (10*a*) and in case of the movement of the spindle being locked because of the change in the direction of rotation of the motor, safety cut-off means (5*a*, 21–24, 21'–22') drawn by the spindle (10) are interposed between the valve inlet conduit (6) and the outlet conduits (7,8,20) to prevent gas escaping, while the modulating cut-off member (21,21') is still not actuated.

5 Claims, 2 Drawing Sheets

POWER OPERATED GAS VALVE FOR HEATING, WITH A SAFETY VALVE

The present invention relates to the regulation of the supply of fuel gas to a domestic heating appliance by means of a control valve driven by an electric motor, modulating the flow in response to the variations in temperature, the valve being of lift valve type, with an electromagnetic safety valve.

PRIOR ART

EP-0875720-A2 and equivalent U.S. Pat. No. 5,979,484 disclose a gas flow regulating valve actuated by a rotary motor in both directions, for supplying a heating appliance. The valve is adapted to supply one flow to a appliance main burner by way of a valve outlet conduit and a pilot flow to a appliance pilot burner by way of a valve pilot outlet conduit. Motor actuation is controlled by an ambient temperature sensor, moving the valve spindle linearly for the gradual opening of the main flow outlet conduit valve hole. The valve in the afore-mentioned publication further comprises a valve member coupled to the spindle, which, being actuated by a motor, moves in both directions by way of an axial flow conduit to control the flow of gas through the valve elements, and a safety valve magnetic unit pushed by the free end of the valve spindle.

DISCLOSURE OF THE INVENTION

The object of the invention is a valve for regulating the flow of gas to a domestic environment heating appliance, of the lift type actuated by a motor and with a central flow conduit in the valve body, which comprises a flame safety valve at the valve inlet and safety means for closing the central conduit to prevent gas escaping from the valve.

The valve spindle is moved linearly by the motor in both directions by changing the direction of rotation, in the first direction to actuate the flame safety valve for its resetting, and in the second opposing direction to regulate gas flow by means of a modulating valve. The safety valve is held open by a thermocouple heated by a pilot flame in the heater appliance. In the event of motor rotation getting locked, once the safety valve has opened, the valve spindle would continue exerting pressure on the flame safety valve and stopping it from closing if the pilot flame goes out. The control valve according to the invention has safety cut-off means to prevent the flow of gas to any of the valve outlet conduits, even though the electromagnetic flame safety valve is open, until the valve spindle has moved forward away from it. The valve spindle is a one-piece stem with its forward movement controlled by a step motor, a single valve cut-off member permits the supply of a pilot flow and a main flow modulated between a minimum and a maximum flow, and said means for the safety cut-off of the flow conduit between the gas inlet and outlet are coupled to the valve spindle and are of simple construction.

DETAILED DESCRIPTION OF THE INVENTION

Figure 1:
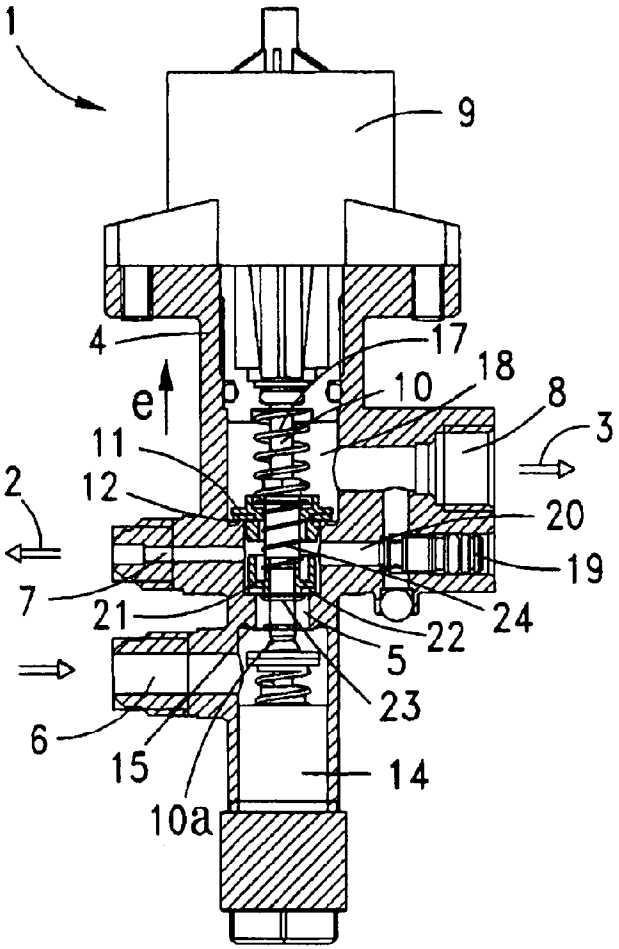
FIG. 1 is a sectional view of an initial embodiment of a gas regulating valve with the "closed" position with the flame safety valve in the inlet actuated.

In reference to FIGS. 1–4, a first embodiment 1 (FIGS. 1–2) and a second embodiment (FIGS. 3–4) of a regulating valve according to the invention are described here, adapted for the supply of a pilot flow 2 to a pilot burner and of a main flow 3 to a main burner of a heating appliance, controlled by an ambient temperature sensor, not represented in the drawings.

Both regulating valve embodiments 1, 1' comprise a valve body 4 with an axial flow conduit 5 traversing the body 4, an inlet conduit 6 from an external gas source, an outlet conduit 7 for a pilot flow 2 and an outlet conduit 8 for a main flow 3, all oriented transversely to the flow conduit 5, and a valve spindle 10. A step motor 9 is located on the body 4 and actuates the valve spindle 10, and a magnetic safety assembly 14 is housed in the opposite end of the body 4 forming a flame safety valve 14,15. The motor 9 moves the valve spindle 10 linearly for the gradual opening of a modulating valve 11,12 which regulates the passage of the main gas flow 3 to the outlet conduit 8 from a regulating chamber 18. The main flow 3 is supplied in two states: a "minimum" flow 3 dependent on the adjustment of the bypass screw 19 and a modulated flow 3, dependent on the travel 13 effected by the modulating valve cut-off member 11.

Following the mode of operation of the regulating valve 1,1', the valve spindle 10 is moved linearly by the motor 9 in both directions of the flow conduit 5. At the start of the regulating valve 1,1' operation , the spindle 10 moves in the opposite direction to the motor 9 and one end 10*a* of the valve spindle pushes the magnetic assembly 14 overcoming the resistance of its return spring (FIG. 1 and FIG. 3). Thus, the safety valve 14, 15 is open and the gas enters the axial conduit 5. In the direction "e" (FIG. 1) of forward movement of the spindle 10 towards the motor 9, the cut-off member 11 gradually lifts off its seat 12, overcoming the resistance of a return spring 17. The cut-off member 11 is held in successive operating positions along the regulating chamber 18 formed downstream in series with the flow conduit 5. In the cut-off member 11 regulating position shown in FIG. 2 and in FIG. 4, the outlet conduit 8 supplies a "maximum" flow.

When initially the modulating valve 11,12 is still closed by the pressure of the return spring 17, a pilot flow 2 is supplied by the outlet conduit 7, and a "minimum" main flow 3 is supplied via a communicating hole 20 fitted with said "bypass" screw 19, which forms a bridge to the regulating chamber 18, setting the gas access from the safety valve seat 15 to the main outlet conduit 8 in direct communication. The pilot outlet conduit 7 and said communicating hole 20 start transverse from the central conduit 5 each of them extending in a direction towards a side of the valve body 4 opposite to the other.

When the direction of motor 9 rotation changes, the spindle 10 retracts in direction "e" at the termination of a period of heating of the thermocouple which supplies the magnetic assembly 14, whereby the safety valve 14,15 may close in the event of the pilot flame going out. When the motor 9 has to change direction of rotation for the retraction of the spindle 10, motor failure may occur and the consequent locking of spindle 10 forward movement. In this case it is necessary to prevent gas escaping. The two regulating valve embodiments 1,1' are provided with cut-off means

21–24, 21'–22' respectively, housed in an intermediate portion of the flow conduit 5, between the pilot outlet conduit 7 and the direct communication hole 20 with the main outlet conduit 8.

Figure 2:
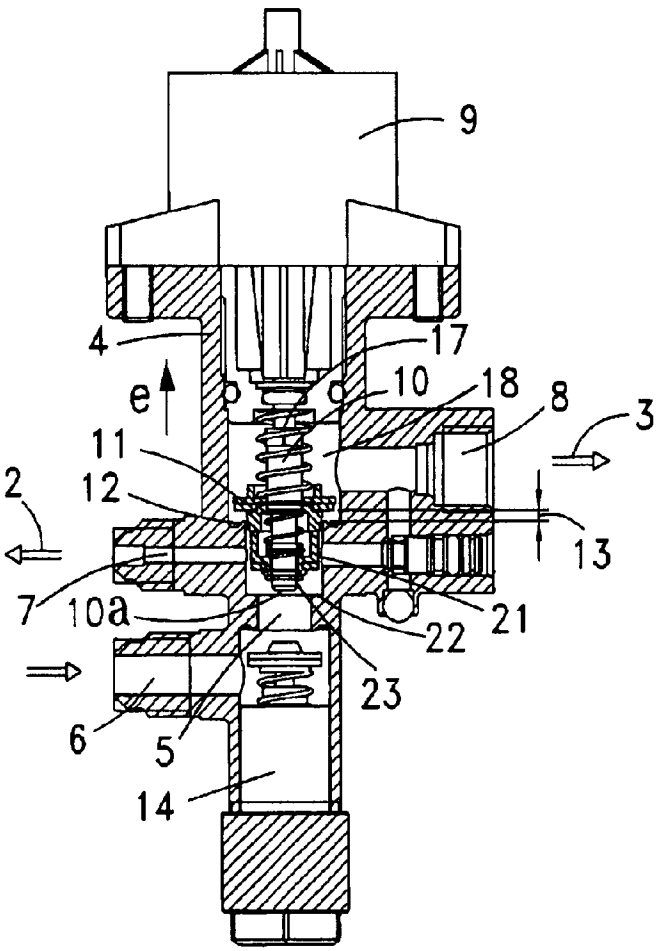
FIG. 2 is a sectional view of the embodiment of the valve of FIG. 1 in the "open" condition for the passage of maximum flow.
Figure 3:
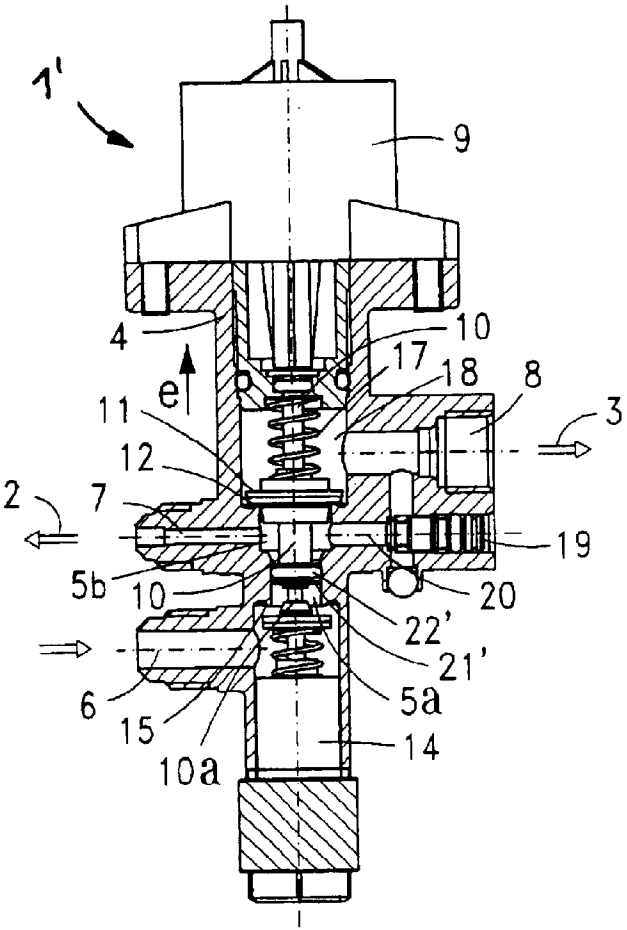
FIG. 3 is a sectional view of a second embodiment of a gas regulating valve in the "closed" position, with the flame safety valve in the inlet actuated.

In reference to FIGS. 1–2, in an initial regulating valve embodiment 1 the flow conduit 5 cut-off means 21–24 comprise a lift valve 21,22 with a flat disc-shaped cut-off member 21 resting on a seat 22 coaxial with the spindle 10, and located upstream of the modulating valve cut-off member 11. The cut-off member 21 is drawn by a washer 23 attached to the spindle 10, overcoming the force of a return spring 24.

The safety cut-off member 21 is raised by the forward movement "e" of the spindle 10 up to two relative positions (not represented in the drawings) prior to that of modulating valve 11,12 opening. In a prior position of the spindle 10 the tip 10*a* of the spindle is separated from the magnetic assembly 14, but the flow of gas to the outlet conduits 7 and 20 remains closed. In a subsequent intermediate position of the spindle 10, the safety cut-off member 21 is separated from its seat 22 so as to supply pilot flow 2 and said "minimum" flow via the direct outlet conduit 20, but the regulating cut-off member 11 still remains closed on its seat 12 owing to the fact that the compression coefficient "k" of the modulating valve spring is higher than that of the spring 24 of the safety cut-off valve 21,22. As the forward movement of the spindle 10 continues, the modulating valve cut-off member 11 also effects a travel 13, so that now the main flow 3 is also supplied via the outlet conduit 8. In the embodiment represented in FIG. 2 the cut-off member 11 of the modulating valve 13 has completed a maximum travel 13, drawn by the safety cut-off member 21, so as to supply a "maximum flow".

Figure 4:
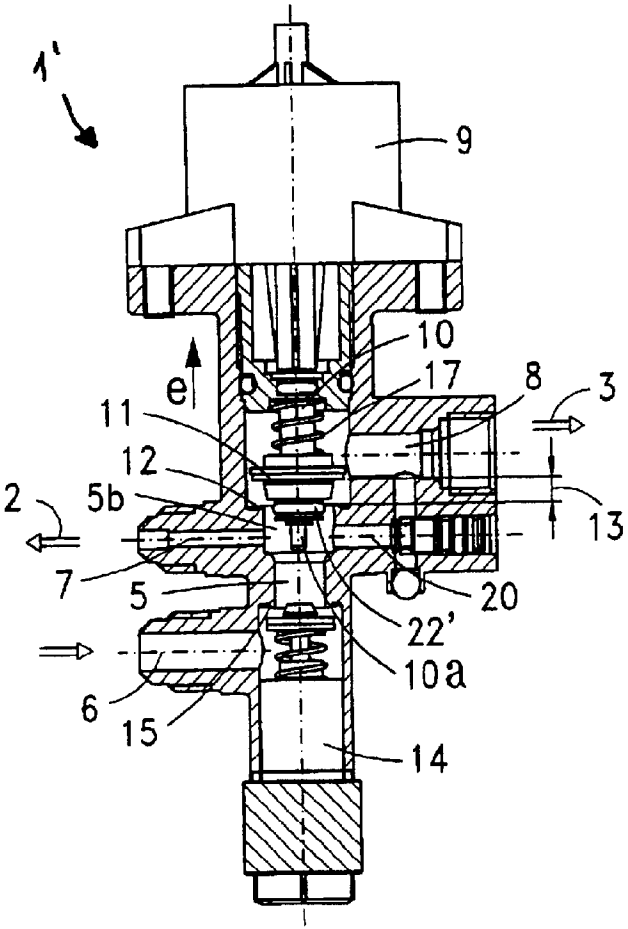
FIG. 4 is a sectional view of the regulating valve of FIG. 3, in the "open" position for the passage of "maximum flow".

In reference to FIGS. 3–4, in a second embodiment of the regulating valve, the flow conduit 5 sealing means 5*a*, 21',22' comprise a flat disc 21' attached to spindle 10 encircled by a sealing O-ring 22, which slides snugly in an intermediate portion 5*a* of the axial flow conduit 5, adjacent downstream to the safety valve 14,15. In this embodiment 1' represented in FIGS. 3–4, the flow conduit 5 downstream of the regulating chamber 18 is made up of two portions 5*a*,5*b* of conduit, both of smaller diameter than the chamber. The pilot flow outlet conduit 7 and the direct outlet conduit 20 leave transversely from the portion 5*b* of conduit adjacent to the chamber. The sealing disc 21',22' slides in the portion 5*a* of conduit located upstream, and it is of smaller diameter than the portion 5*b* of conduit adjacent to the regulating chamber 18. In this way, in its forward movement "e", once the safety valve has opened 14, 15, the spindle 10 will effect a prior movement during which the safety sealing disc 21',22' slides along the portion 5*a* of conduit to seal it and prevent gas escaping (FIG. 3), and in this way it is ensured that the spindle 10 is not locked when the motor 9 changes its direction of rotation. When the disc 21',22' is positioned in the portion 5*b* of larger diameter conduit, the passage is open to the pilot outlet conduit 7 and to the "minimum flow" communication hole 20. In the position of spindle 10 represented in FIG. 4 the sealing disc 21',22' is exerting pressure on the modulating valve cut-off member 11 and raising it from its seat 12, thereby supplying a maximum flow 3 along the outlet conduit 8.

What is claimed is:

1. A motor-operated valve for regulating a gas flow adapted for the supply of a main gas flow and a pilot gas flow to an environmental heating appliance, comprising:

a valve body (4) with a gas inlet conduit (6), an axial flow conduit (5) and a plurality of gas outlet conduits (7,8,20) transverse to said axial flow conduit;

a valve spindle (10,10*a*) that slides linearly along said axial flow conduit (5) and at least one cut-off member (11) provided with a return spring (17) coupled to the valve spindle (10) to modulate a gas flow (3) directed to a main outlet conduit (8);

a motor (9) coupled on the valve body for actuating the valve spindle and its axial movement in both directions;

a flame safety valve (14,15) provided with a magnetic assembly (14) located on one side of the valve body opposite the motor (9) and in series with the inlet conduit (6): wherein the valve spindle (10,10*a*) is a one-piece stem actuated directly by the motor for its linear movement in an initial axial direction, extending from the motor and pushing the safety valve (14,15) to open it initially, and in a second axial direction (e), retracting for the raising of at least said modulating cut-off member (11);

safety cut-off means (21–24) to prevent the flow of gas towards all of the outlet conduits (7,8,20) in case the movement of the spindle (10) is locked because of the motor, wherein said cut-off means are housed in the central flow conduit (5) and are operated by the spindle (10), in a position between the inlet conduit (6) and the outlet conduits (7, 8, 20), whereby in a forward movement (e) of the spindle (10), a free end (10*a*) of the spindle (10) is separated from the safety magnetic assembly (14) and, as the flame safety valve is open, the flow of gas to all of the outlet conduits (7, 8, 20), are kept shut off by the safety cut-off means (21–24), while the flame safety valve (14, 15) remains open.

2. A motor-operated valve for regulating a gas flow according to claim 1, wherein the safety cut-off means (21–24) comprise a cut-off member (21), resting on a valve seat (22) interposed in the central flow conduit (5) downstream of the gas flow modulating cut-off member (11), whereby when the spindle (10) is separated from the magnetic assembly (14), as the flame safety valve (14,15) is open, the safety cut-off member (21) is drawn by the valve spindle irrespective of a position of the flow modulating cut-off member (21).

3. A motor-operated valve for regulating a gas flow according to claim 1, wherein the safety cut-off means (21–24) comprise a cut-off member (21), resting on a valve seat (22), interposed in the central flow conduit (5) by means of the pressure of a return spring which has a compression coefficient lower than that of the return spring (17) of the cut-off member (11) for regulating the gas flow (3), whereby the safety cut-off member (21') is raised by the forward movement (e) of the spindle (10), while the regulating cut-off member (11) remains in position against the valve seat (22).

4. A motor-operated valve for regulating a gas flow adapted for the supply of a main gas flow and a pilot gas flow to an environmental heating appliance, comprising:

a valve body (4) with a gas inlet conduit (6), a central flow conduit (5), extended axially in the valve body, and a number of gas outlet conduits (7,8) transverse to said central flow conduit;

a valve spindle (10,10*a*) that slides linearly along the central flow conduit (5) and at least one cut-off member (11) coupled to the valve spindle (10) to modulate a gas flow (3) directed to a main outlet conduit (8);

a motor (9) coupled on the valve body for actuating the valve spindle and axial movement of the valve spindle in both directions;

a flame safety valve (14,15) provided with a magnetic assembly (14) located on one side of the valve body opposite the motor (9) side and in series with the inlet conduit (6);

wherein the valve spindle (10,10*a*) is a one-piece stem actuated directly by the motor for linear movement in an initial axial direction, extending from the motor and pushing the safety valve (14,15) to open the safety valve (14, 15) initially, and in a second axial direction (e), retracting for the raising of at least said modulating cut-off member (11);

said central flow conduit, comprising two intermediate portions (5*a*,5*b*) of conduit arranged in series, each intermediate portion (5*a*,5*b*) having a different diameter, between the flame safety valve (14,15) and the modulating cut-off member (11), wherein the smaller-diameter intermediate conduit portion (5*a*), is downstream of both gas flow outlet conduits (7,8);

safety cut-off means (5*a*,21–24,21'–22') to prevent the flow of gas towards the outlet conduits (7,8,20) in case the movement of the spindle (10) is locked because of the motor, wherein said cut-off means are housed in the smaller-diameter intermediate conduit portion (5*a*) and are drawn by the spindle (10), whereby, as the flame safety valve is open, the flow of gas to all of the outlet conduits (7,8,20) are kept shut off.

5. A motor-operated valve for regulating a gas flow according to claim 4, wherein said safety cut-off members (5*a*,21–24,21'–22') comprise a flat disc (21') attached to the valve shaft and encircled by a sealing O-ring (22'), the flat disc sliding in said smaller-diameter conduit portion (5*a*), located adjacent to and downstream of the flame safety valve (14,15).

* * * * *